US010036562B2

(12) United States Patent
Takenaka et al.

(10) Patent No.: US 10,036,562 B2
(45) Date of Patent: Jul. 31, 2018

(54) AIR-CONDITIONING APPARATUS

(75) Inventors: Naofumi Takenaka, Chiyoda-ku (JP); Shinichi Wakamoto, Chiyoda-ku (JP); Koji Yamashita, Chiyoda-ku (JP); Takeshi Hatomura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 896 days.

(21) Appl. No.: 14/408,684

(22) PCT Filed: Aug. 3, 2012

(86) PCT No.: PCT/JP2012/004956
§ 371 (c)(1),
(2), (4) Date: Dec. 17, 2014

(87) PCT Pub. No.: WO2014/020651
PCT Pub. Date: Feb. 6, 2014

(65) Prior Publication Data
US 2015/0292756 A1 Oct. 15, 2015

(51) Int. Cl.
*F24F 11/00* (2018.01)
*F24F 5/00* (2006.01)
(Continued)

(52) U.S. Cl.
CPC ..... *F24F 5/001* (2013.01); *F24F 11/83* (2018.01); *F25B 13/00* (2013.01); *F25B 41/003* (2013.01);
(Continued)

(58) Field of Classification Search
CPC ..... F25B 49/02; F25B 13/00; F25B 2400/13; F25B 2600/2515; F25B 41/003;
(Continued)

(56) References Cited

U.S. PATENT DOCUMENTS

2004/0093893 A1 5/2004 Tanimoto et al.

FOREIGN PATENT DOCUMENTS

JP 2003-202162 7/2003
JP 2007-271094 10/2007
(Continued)

OTHER PUBLICATIONS

Extended Search Report dated Apr. 1, 2016 in European Patent Application No. 12882176.6.
(Continued)

*Primary Examiner* — Keith Raymond
*Assistant Examiner* — Nael Babaa
(74) *Attorney, Agent, or Firm* — Oblon, McClelland, Maier & Neustadt, L.L.P.

(57) ABSTRACT

An air-conditioning apparatus divides an outdoor heat exchanger to form parallel heat exchangers and supplies part of refrigerant from a compressor to the parallel heat exchangers alternately to perform defrosting, performs medium-pressure defrosting in which part of the refrigerant from the compressor is decompressed and supplied to a parallel heat exchanger to be subjected to defrosting, and the refrigerant after being used for defrosting is injected into the compressor. A first flow switching unit performs switching of a connection mode of ends of the parallel heat exchangers on compressor side, where the pressure changes among high pressure, medium pressure, and low pressure according to operation contents, to one of three modes: a mode with the ends connected to the compressor discharge side, a mode with the ends connected to the compressor suction side, and a mode with the ends connected to neither the discharge nor suction side.

8 Claims, 6 Drawing Sheets

(51) Int. Cl.

| | |
|---|---|
| ***F25B 13/00*** | (2006.01) |
| ***F25B 47/02*** | (2006.01) |
| ***F25B 49/02*** | (2006.01) |
| ***F25B 41/00*** | (2006.01) |
| ***F24F 11/83*** | (2018.01) |
| *F24F 11/84* | (2018.01) |

(52) U.S. Cl.
CPC ..... *F25B 47/022* (2013.01); *F25B 49/02* (2013.01); *F24F 11/84* (2018.01); *F25B 2313/0233* (2013.01); *F25B 2313/0251* (2013.01); *F25B 2313/02732* (2013.01); *F25B 2400/13* (2013.01); *F25B 2600/2515* (2013.01)

(58) Field of Classification Search
CPC ..... F25B 47/022; F25B 47/02; F25B 2313/02322; F25B 2313/02332; F25B 2313/02522; F25B 2313/009; F25B 2313/0251; F25B 2313/02732; F24F 2011/0082; F24F 5/001
USPC ..... 62/113, 156
See application file for complete search history.

(56) References Cited

FOREIGN PATENT DOCUMENTS

| | | |
|---|---|---|
| JP | 2007-285545 | 11/2007 |
| JP | 2009-085484 | 4/2009 |
| JP | 2010-014344 | 1/2010 |
| JP | 2010-139097 | 6/2010 |
| JP | 2012-057678 | 3/2012 |
| WO | 2012/014345 | 2/2012 |

OTHER PUBLICATIONS

International Search Report dated Oct. 16, 2012, 2013 in PCT/JP12/004956 Filed Aug. 3, 2012.

AIR-CONDITIONING APPARATUS

TECHNICAL FIELD

The present invention relates to an air-conditioning apparatus.

BACKGROUND ART

In recent years, in terms of global environmental protection, cases where heat-pump air-conditioning apparatuses which use air as a heat source are introduced even in cold regions, instead of known boiler-type heating devices which burn fossil fuels to perform heating, have increased. With heat-pump air-conditioning apparatuses, heating is able to be performed more efficiently by the amount of heat supplied from air, in addition to electric input to a compressor. In contrast, however, when the temperature of outside air is low, frost is deposited on an outdoor heat exchanger serving as an evaporator, it is therefore necessary to perform defrosting to melt frost deposited on the outdoor heat exchanger. As a method for performing defrosting, there is a method for reversing a refrigeration cycle. With this method, however, heating of a room is stopped during defrosting. Therefore, there is a problem of impairing comfort.

As a method for being able to perform heating even during defrosting, methods have been developed (see, for example, Patent Literature 1, Patent Literature 2, and Patent Literature 3), in which an outdoor heat exchanger is divided, with part of the outdoor heat exchangers performing defrosting, while the other heat exchangers being caused to operate as evaporators, which receive heat from air and thus perform heating.

In Patent Literature 1, in the case where an outdoor heat exchanger is divided into plural parallel heat exchangers and defrosting of one parallel heat exchanger is performed, by closing a flow rate control device which is installed near the other parallel heat exchanger and opening a flow rate control device at a bypass pipe which causes a refrigerant to take a detour to the inlet of the parallel heat exchanger from a discharge pipe of a compressor, part of a high-temperature refrigerant that has been discharged from the compressor is caused to flow into the parallel heat exchanger directly. Then, after defrosting of the one parallel heat exchanger is completed, defrosting of the other parallel heat exchanger is performed. At this time, defrosting of the other parallel heat exchanger is performed in a state where the pressure of a refrigerant inside the other parallel heat exchanger is substantially the same as the suction pressure of the compressor (low-pressure defrosting).

In Patent Literature 2, plural outdoor units and at least one or more indoor units are provided. The direction of connection of a four-way valve in only an outdoor unit that includes an outdoor heat exchanger subjected to defrosting is reversed relative to that in a heating operation, so that a refrigerant that has been discharged from a compressor is caused to flow into the outdoor heat exchanger directly. At this time, defrosting is performed in a state where the pressure of a refrigerant in the heat exchanger subjected to defrosting is substantially the same as the discharge pressure (high-pressure defrosting).

In Patent Literature 3, an outdoor heat exchanger is divided into plural parallel heat exchangers. By causing part of a high-temperature refrigerant that has been discharged from a compressor to flow into the parallel heat exchangers alternately, and defrosting of the parallel heat exchangers is performed alternately. Accordingly, continuous heating can be performed without reversing a refrigeration cycle. Further, in Patent Literature 3, medium-pressure defrosting is proposed in which defrosting is performed in a state where the pressure of a refrigerant in a parallel heat exchanger subjected to defrosting is not the same as the discharge pressure or the suction pressure but is slightly higher than that at 0 degrees Centigrade when converted into a saturation temperature and the refrigerant is returned to an injection part of an injection compressor.

CITATION LIST

Patent Literature

Patent Literature 1: Japanese Unexamined Patent Application Publication No. 2009-085484 (Page 11, FIG. 3)

Patent Literature 2: Japanese Unexamined Patent Application Publication No. 2007-271094 (Page 8, FIG. 2)

Patent Literature 3: International Publication No. WO 2012/014345 (Page 9, FIG. 1)

SUMMARY OF INVENTION

Technical Problem

In low-pressure defrosting such as Patent Literature 1, since an evaporator (a parallel heat exchanger which is not being subjected to defrosting) operating in the same pressure zone as that of a parallel heat exchanger which is being subjected to defrosting receives heat from outside air, the evaporating temperature of a refrigerant is lower than the outside air temperature. Therefore, even at the parallel heat exchanger that is being subjected to defrosting, the saturation temperature is at or below 0 degrees Centigrade, and condensed latent heat of the refrigerant cannot be used for melting frost (0 degrees Centigrade). Thus, defrosting is performed inefficiently.

In contrast, in low-pressure defrosting of patent Literature 2, the subcooling (degree of subcooling) of a refrigerant at the outlet of an outdoor heat exchanger for which defrosting is completed is large, and temperature distribution occurs. Therefore, high-efficient defrosting cannot be performed. Further, the amount of liquid refrigerant inside the outdoor heat exchanger increases by the large amount of subcooling. Therefore, a time may be required for movement of the liquid refrigerant.

In medium-pressure defrosting of Patent Literature 3, by controlling the saturation temperature of a refrigerant to be slightly higher (about between 0 degrees Centigrade to about 10 degrees Centigrade) than 0 degrees Centigrade, defrosting of the entire parallel heat exchanger can be performed efficiently and with less temperature variations, compared to Patent Literature 1 and Patent Literature 2, while utilizing condensed latent heat. However, in Patent Literature 3 pressures before and after a flow switching device for performing switching of connection on the compressor side of the parallel heat exchangers greatly vary among cooling, heating, and defrosting. Therefore, as the flow switching device, a solenoid valve capable of being controlled irrespective of the pressures before and after thereof is used.

However, in general, solenoid valves have a Cv value smaller than those of four-way valves, three-way valves, and the like, which are generally used for air-conditioning as flow switching valves. More specifically, while four-way valves with a maximum Cv value of up to about "17" are generally and widely distributed, commonly available solenoid valves are those with a maximum Cv value of up to about "3". There is, therefore, a problem in that using a solenoid valve as a flow switching valve causes a large amount of pressure loss. In terms of pressure loss, it is preferable that a simple switching valve, such as a four-way valve or a three-way valve, is used, instead of using a solenoid valve as a flow switching valve.

However, because of the structure of four-way valves and three-way valves, they need to be connected so that a refrigerant flows in a single direction. That is, in order to properly operate a four-way valve or three-way valve, the pressure of one port needs to be always higher than the pressure of the other port. Therefore, in a part in which pressure inside an outdoor heat exchanger largely changes among pressure zones: high pressure in cooling; low pressure in heating; and medium pressure in defrosting, it is difficult to use a four-way valve or a three-way valve. Thus, a solenoid valve having a complicated bidirectional structure is inevitably used.

Further, solenoid valves through which a refrigerant flows in a single direction has a Cv value in a range wider than that of bidirectional solenoid valves. Therefore, improvement in pressure loss can be expected by using a unidirectional solenoid valve instead of a bidirectional solenoid valve. However, similar to the case of four-way valves and three-way valves, unidirectional solenoid valves also need to be connected so that a refrigerant flows in a single direction, and thus in actuality cannot be used.

As described above, medium-pressure defrosting in Patent Literature 3 has the advantage of being able to perform defrosting efficiently but, at the same time, has a problem that a bidirectional solenoid valve having a complicated structure needs to be used, as a flow switching valve, which causes an increase in the cost.

The present invention has been made in order to solve the above-mentioned problems, and an object of the present invention is to provide an air-conditioning apparatus capable of achieving defrosting using a four-way valve or a three-way valve and a unidirectional solenoid valve having simple structures, without using a bidirectional solenoid valve having a complicated structure.

Solution to Problem

An air-conditioning apparatus according to the present invention includes a main circuit which is configured such that a compressor, a cooling/heating switching device that is connected between a discharge pipe of the compressor and a suction pipe of the compressor and that performs switching of a flow direction of a refrigerant, indoor heat exchangers, first flow rate control devices, and an outdoor heat exchanger that is divided into plural parallel heat exchangers are connected by piping; a first bypass pipe which has one end connected to the discharge pipe, and the other end divided into branch pipes which are respectively connected to first connection pipes that extend from the plural parallel heat exchangers toward the first flow rate control devices, and which supplies part of the refrigerant that has been discharged from the compressor and has then been decompressed at an expansion device to a parallel heat exchanger of the parallel heat exchangers subjected to defrosting; a second bypass pipe which has one end connected to an injection port of the compressor that communicates with a compression chamber in a process of compression, and the other end divided into branch pipes which are respectively connected to second connection pipes that extend from the respective plural parallel heat exchangers toward the compressor, and in which the refrigerant that has passed through the plural parallel heat exchangers is injected via the injection port; a first flow switching unit which performs switching of a connection mode of ends of the plural parallel heat exchangers on a side of the compressor to one of three modes: a mode in which the ends are connected to a discharge side of the compressor; a mode in which the ends are connected to a suction side of the compressor; and a mode in which the ends are connected to neither the discharge side nor the suction side of the compressor; a second flow switching unit which performs switching of a connection mode of ends of the plural parallel heat exchangers on the sides opposite to the compressor to one of a mode in which the ends are connected to the first bypass pipe and a mode in which the ends are connected to a main pipe in the main circuit; and a third flow switching unit which opens and closes a flow passage inside the second bypass pipe and connects one of the plural parallel heat exchangers to the injection port when the flow passage is opened. The first flow switching unit includes first connection switching devices that are provided at the second connection pipes and perform switching of a connection destination of the second connection pipes to one of a high-pressure pipe which branches off from the discharge pipe and a low-pressure pipe which branches off from the suction pipe, and second connection switching devices that are provided at respective pipes connecting the second connection pipes with the high-pressure pipe and that perform switching of a connection mode of the second connection pipes to one of a mode in which the second connection pipes are connected to the high-pressure pipe and a mode in which the second connection pipes are disconnected from the high-pressure pipe, when the connection destination of the second connection pipes is switched toward the high-pressure pipe by the first connection switching devices. The first connection switching devices are configured such that check valves are connected in series to third ports of high/low pressure switching devices each including a three-way valve or a four-way valve that a first port of which is connected to the high-pressure pipe and a second port of which is connected to the low-pressure pipe so that the refrigerant is allowed to flow only from sides of the second connection pipes to the high/low pressure switching devices. The second connection switching devices are switching devices which each include a unidirectional solenoid valve, or switching devices that are configured such that check valves are connected in series to third ports of three-way valves or four-way valves that first ports of which are connected to the high-pressure pipe and second ports of which are connected to the low-pressure pipe so that the refrigerant is allowed to flow only from the three-way valves or the four-way valves to the second connection pipes.

Advantageous Effects of Invention

According to the present invention, an air-conditioning apparatus capable of performing high-efficiency defrosting, without stopping heating by an indoor unit, can be obtained, by not using a bidirectional solenoid valve having a complicated structure but by using a simple valve.

DESCRIPTION OF EMBODIMENTS

Hereinafter, embodiments of the present invention will be explained with reference to the drawings.

Embodiment 1

Figure 1:
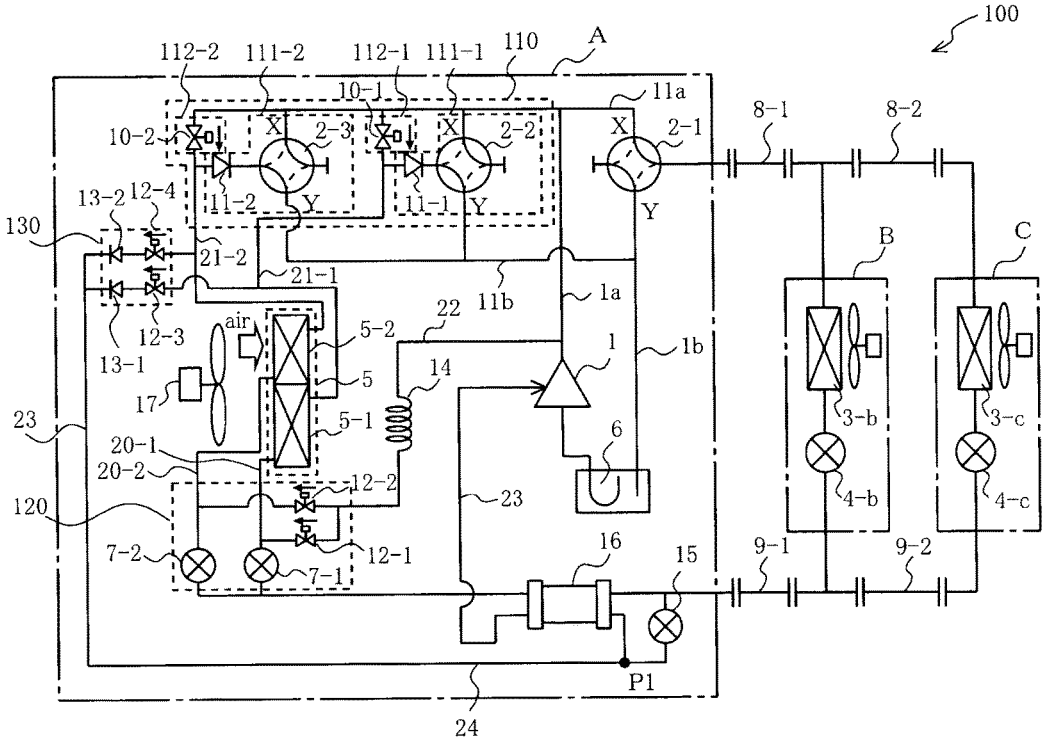
FIG. 1 is a refrigerant circuit diagram illustrating a refrigerant circuit configuration of an air-conditioning apparatus according to Embodiment 1 of the present invention.

FIG. 1 is a refrigerant circuit diagram illustrating a refrigerant circuit configuration of an air-conditioning apparatus 100 according to Embodiment 1 of the present invention. In FIG. 1 and other figures mentioned below, parts referred to with the same signs correspond to the same parts or parts equivalent to the parts. The same applies throughout the description. Furthermore, forms of component parts illustrated in the description are merely exemplifications and are not limited to the described forms.

The air-conditioning apparatus 100 includes an outdoor unit A and indoor units B and C which are connected in parallel to each other. The outdoor unit A and the indoor units B and C are connected by first extension pipes 8-1 and 8-2 and second extension pipes 9-1 and 9-2. The air-conditioning apparatus 100 also includes a controller (not illustrated). The controller controls a cooling operation, and a heating operation (normal heating operation and heating and defrosting operation) of the indoor units B and C.

As a refrigerant, a fluorocarbon refrigerant (for example, an HFC-type refrigerant, such as an R32 refrigerant, R125, or R134a, a mixture of the above refrigerants, such as R410A, R407c, or R404A) or an HFO refrigerant (for example, HFO-1234yf, HFO-1234ze(E), or HFO-1234ze (Z)) may be used. In addition, a refrigerant used for vapor-compression heat pumps, such as a $CO_2$ refrigerant, an HC refrigerant (for example, a propane or isobutane refrigerant), an ammonia refrigerant, or a mixed refrigerant of the above-mentioned refrigerants, such as a mixed refrigerant of R32 and HFO-1234yf, may be used.

In Embodiment 1, an example in which two indoor units are connected to one outdoor unit is explained. However, only one indoor unit may be connected or two or more outdoor units may be connected in parallel. Furthermore, a refrigerant circuit configuration which achieves a cooling and heating simultaneous operation in which each unit selects cooling or heating, can be provided, by connecting three extension pipes in parallel or providing a switching valve in the indoor unit.

A configuration of a refrigerant circuit in the air-conditioning apparatus 100 will now be explained.

The refrigerant circuit of the air-conditioning apparatus 100 includes a main circuit in which a compressor 1, a cooling/heating switching device 2-1 for switching between cooling and heating, indoor heat exchangers **3-*b* and 3-*c*, first flow rate control devices 4-*b* and 4-*c* that are freely opened and closed, and an outdoor heat exchanger 5 are sequentially connected by a pipe. The main circuit further includes an accumulator 6. However, the accumulator 6** is not necessarily essential and may be omitted.

The compressor 1 is a compressor into which a medium-pressure refrigerant is able to be injected in the process of compression of a refrigerant from low pressure to high pressure.

The cooling/heating switching device 2-1 is connected between a discharge pipe **1*a* and a suction pipe 1*b* of the compressor 1 and includes, for example, a four-way valve for switching the flow direction of a refrigerant. In a heating operation, the cooling/heating switching device 2-1 is connected in the direction of solid lines in FIG. 1. In a cooling operation, the cooling/heating switching device 2-1 is connected in the direction of a dotted line in FIG. 1**.

The outdoor heat exchanger 5 is divided into plural parallel heat exchangers, namely parallel heat exchangers 5-1 and 5-2, in this configuration. The parallel heat exchangers 5-1 and 5-2 are formed by dividing the outdoor heat exchanger 5 that extends in a horizontal direction in the casing of the outdoor unit A. Although the outdoor heat exchanger 5 may be divided horizontally, horizontal division causes a refrigerant to enter the parallel heat exchangers 5-1 and 5-2 from left and right ends of the outdoor unit A, which complicates pipe connection. Thus, it is preferable that the outdoor heat exchanger 5 is divided in a vertical direction.

Outdoor air is conveyed to the parallel heat exchangers 5-1 and 5-2 by an outdoor fan 17. The outdoor fan 17 may be installed at each of the parallel heat exchangers 5-1 and 5-2. However, as illustrated in FIG. 1, only one outdoor fan 17 may be provided.

First connection pipes 20-1 and 20-2 are connected to the parallel heat exchangers 5-1 and 5-2 on sides connected with the first flow rate control devices **4-*b* and 4-*c*. The first connection pipes 20-1 and 20-2 are connected in parallel to a main pipe extending from second flow rate control devices 7-1 and 7-2. The second flow rate control devices 7-1 and 7-2 are provided at the first connection pipes 20-1 and 20-2**, respectively.

Second connection pipes 21-1 and 21-2 are connected to the parallel heat exchangers 5-1 and 5-2 on sides connected with the compressor 1. The second connection pipes 21-1 and 21-2 are connected to the compressor 1 via a first flow switching unit 110.

The first flow switching unit 110 performs switching of a connection mode of the ends of the parallel heat exchangers 5-1 and 5-2 on the side of the compressor 1, to one of three modes: a mode in which these ends are connected to the discharge side of the compressor 1, a mode in which these ends are connected to the suction side of the compressor 1, and a mode in which these ends are connected to neither the discharge side nor the suction side of the compressor 1. The details of the first flow switching unit 110 will be described later.

The refrigerant circuit also includes a first bypass pipe 22 which supplies part of a high-temperature high-pressure refrigerant for the purpose of defrosting that has been discharged from the compressor 1 to the parallel heat exchangers 5-1 and 5-2. One end of the first bypass pipe 22 is connected to the discharge pipe 1*a*. The other end of the first bypass pipe 22 is divided into branch pipes and the branch pipes are connected to the first connection pipes 20-1 and 20-2.

An expansion device 14 is provided at the first bypass pipe 22. Part of the high-temperature high-pressure refrigerant that has been discharged from the compressor 1 is reduced into medium pressure at the expansion device 14 and then supplied to the parallel heat exchangers 5-1 and 5-2. Unidirectional solenoid valves (hereinafter, simply referred to as solenoid valves) 12-1 and 12-2 by which a refrigerant flows in a single direction are provided at the branch pipes which branch off from the first bypass pipe 22. The arrows provided for the solenoid valves 12-1 and 12-2 in FIG. 1 represent refrigerant flow directions in which opening and closing of the valves are possible. The same applies to arrows provided for the other solenoid valves in FIG. 1.

The solenoid valves 12-1 and 12-2 and the second flow rate control devices 7-1 and 7-2 form a second flow switching unit 120 which performs switching of connection destinations of sides of the parallel heat exchangers 5-1 and 5-2 remote from the compressor 1, between the first bypass pipe 22 and the main circuit. Although the expansion device 14 may be a capillary tube illustrated in FIG. 1, a flow rate control device whose opening degree can be adjusted is able to control the capacity of defrosting, and a more efficient operation can thus be performed.

The refrigerant circuit also includes a second bypass pipe 23 for injecting a refrigerant that has flowed out of the parallel heat exchangers 5-1 and 5-2 into the compressor 1. A downstream-side end of the second bypass pipe 23 is connected to an injection port of the compressor 1 which is communicated with a compression chamber in the process of compression. An upstream-side end of the second bypass pipe 23 is divided into branch pipes and the branch pipes are connected to the second connection pipes 21-1 and 21-2.

A third flow switching unit 130 is provided at the second bypass pipe 23. The third flow switching unit 130 opens and closes a flow passage at the second bypass pipe 23 and connects one of the parallel heat exchangers 5-1 and 5-2 to the injection port when the flow passage is opened. The third flow switching unit 130 includes unidirectional solenoid valves (hereinafter, simply referred to as solenoid valves) 12-3 and 12-4 and check valves 13-1 and 13-2, which are provided at branch pipes which branch off from the upstream side of the second bypass pipe 23.

Next, the first flow switching unit 110 will be explained.

The first flow switching unit 110 includes first connection switching devices 111-1 and 111-2 and second connection switching devices 112-1 and 112-2.

The first connection switching devices 111-1 and 111-2 are devices which switch connection destinations of the second connection pipes 21-1 and 21-2 between a high-pressure pipe 11*a* and a low-pressure pipe 11*b*. The first connection switching devices 111-1 and 111-2 are provided at the second connection pipes 21-1 and 21-2 and include four-way valves (high/low pressure switching devices) 2-2 and 2-3 for performing switching of connection between high pressure and low pressure, and check valves 11-1 and 11-2, respectively.

The four-way valves 2-2 and 2-3 each have four ports. First ports (high-pressure ports) X are connected to the high-pressure pipe 11*a* which branches off from the discharge pipe 1*a*. Second ports (low-pressure ports) Y are connected to the low-pressure pipe 11*b*, which branches off from the suction pipe 1*b*. Third ports are connected to the second connection pipes 21-1 and 21-2 via the check valves 11-1 and 11-2. The check valves 11-1 and 11-2 are connected in series with the third ports so that a refrigerant can flow only from the second connection pipes 21-1 and 21-2 to the four-way valves 2-2 and 2-3. Fourth ports are closed. With the above-mentioned connection, the first ports X are fixed at high pressure, and the second ports are fixed at low pressure.

The second connection switching devices 112-1 and 112-2 are devices that switch between a state where the second connection pipes 21-1 and 21-2 are connected to the high-pressure pipe 11*a* and a state where the second connection pipes 21-1 and 21-2 are disconnected from the high-pressure pipe 11*a* when the connection destinations of the second connection pipes 21-1 and 21-2 are switched to the high-pressure pipe 11*a* side by the first connection switching devices 111-1 and 111-2 (when the four-way valves 2-2 and 2-3 are switched to the dotted lines side in FIG. 1). The second connection switching devices 112-1 and 112-2 include unidirectional solenoid valves 10-1 and 10-2 (hereinafter, referred to as solenoid valves) provided at pipes which connect the second connection pipes 21-1 and 21-2 with the high-pressure pipe 11*a*.

With the first flow switching unit 110 configured as described above, a selection can be freely made from three options: a state where the parallel heat exchangers 5-1 and 5-2 are connected to the discharge side of the compressor 1; the parallel heat exchangers 5-1 and 5-2 are connected to the suction side of the compressor 1; and the parallel heat exchangers 5-1 and 5-2 are not connected to either side. In the case where the parallel heat exchangers 5-1 and 5-2 are connected to neither the discharge side nor the suction side of the compressor 1 by the first flow switching unit 110, the parallel heat exchangers 5-1 and 5-2 are connected to the injection port of the compressor 1 by the third flow switching unit 130.

Figure 2:
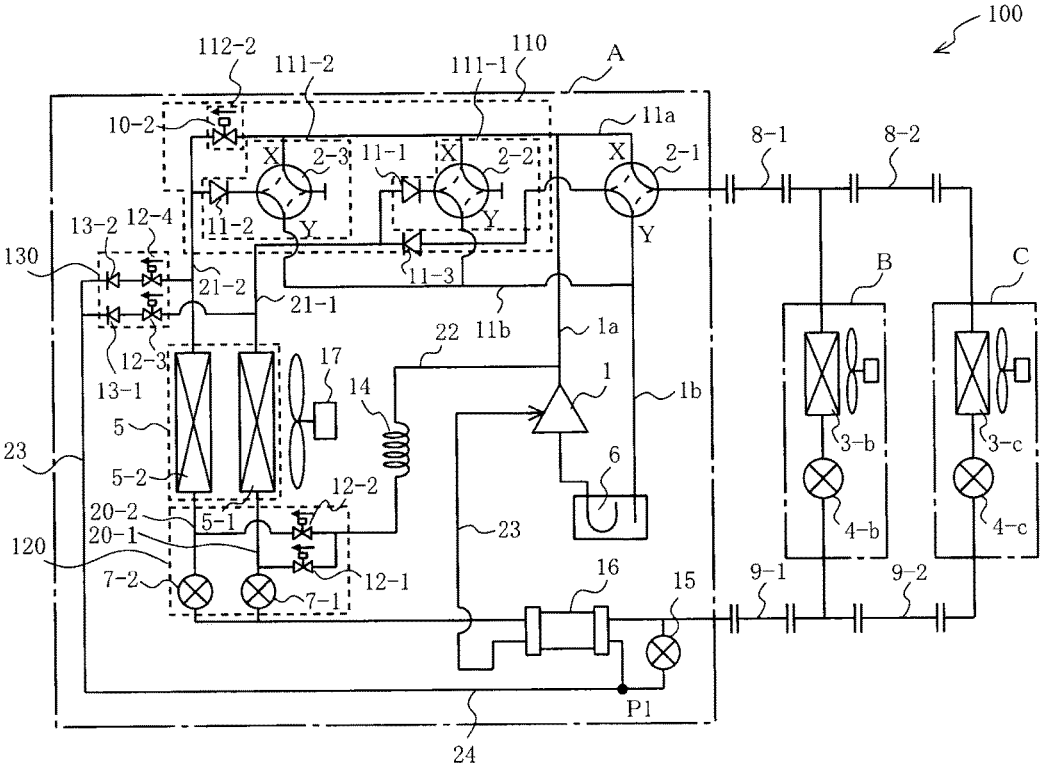
FIG. 2 is a refrigerant circuit diagram illustrating a refrigerant circuit configuration of the air-conditioning apparatus according to Embodiment 1 of the present invention.

Although the configuration in which solenoid valves 10-1 and 10-2 are used as the second connection switching devices 112-1 and 112-2 is illustrated in FIG. 1, functions of the solenoid valve 10-1, which is one of the solenoid valves 10-1 and 10-2, and the function of the four-way valve 2-1 may be integrated together. Therefore, a second connection switching device of a different form may be provided, as illustrated in FIG. 2. That is, a pipe connected to the second connection pipe 21-1 may be provided at the closed fourth port of the four-way valve 2-1, and a check valve 11-3 may be provided at the pipe. This configuration also has a function equivalent to the circuit illustrated in FIG. 1. In FIG. 2, in terms of simplification of illustration, the positions of the parallel heat exchangers 5-1 and 5-2 are different from those in FIG. 1 and it is illustrated as if the parallel heat exchangers 5-1 and 5-2 are arranged in parallel in an air-blowing direction of the fan 17. However, in actuality, the parallel heat exchangers 5-1 and 5-2 are arranged in parallel in a direction orthogonal to the air-blowing direction of the fan 17, as with FIG. 1. The same applies to the figures described below.

The refrigerant circuit also includes a third flow rate control device 15 and an inner heat exchanger 16. The third flow rate control device 15 reduces the pressure of a refrigerant split from a refrigerant that has flowed out of the first flow rate control devices 4-*b* and 4-*c* in the main circuit.

The inner heat exchanger 16 includes a high-pressure side flow passage and a low-pressure side flow passage. The inner heat exchanger 16 exchanges heat between a refrigerant passing through the high-pressure side flow passage and a refrigerant passing through the low-pressure side flow passage. A refrigerant that has flowed out of the first flow rate control devices 4-*b* and 4-*c* in the main circuit passes through the high-pressure side flow passage. A refrigerant obtained by merging a refrigerant which has passed through the third flow switching unit 130 at the second bypass pipe 23 and part of a refrigerant which has flowed out of the first flow rate control devices 4-*b* and 4-*c* in the main circuit and whose pressure has been reduced at the third flow rate control device 15 together at a merging point P1, passes through the low-pressure side flow passage. Preferably, the third flow rate control device 15 and the inner heat exchanger 16 are installed, in terms of improving the heating capacity. However, this configuration is not necessarily essential, and the third flow rate control device 15 and the inner heat exchanger 16 may be omitted.

Next, various operations performed by the air-conditioning apparatus 100 will be explained. The operation of the air-conditioning apparatus 100 has two types of operation modes: a cooling operation and a heating operation. Further, the heating operation includes a normal heating operation in which both the parallel heat exchangers 5-1 and 5-2, which form the outdoor heat exchanger 5, operate as normal evaporators, and a heating and defrosting operation (continuous heating operation).

In a heating and defrosting operation, defrosting of the parallel heat exchangers 5-1 and 5-2 is performed alternately while continuing a heating operation. That is, while one parallel heat exchanger is caused to operate as an evaporator and perform a heating operation, defrosting of the other parallel heat exchanger is performed. After defrosting of the other parallel heat exchanger is completed, the other parallel heat exchanger is caused to operate as an evaporator and perform a heating operation, and defrosting of the one parallel heat exchanger is performed.

Table 1 provided below illustrates ON/OFF and opening degree adjustment control of individual valves in individual operations of the air-conditioning apparatus 100 in FIG. 1. In Table 1, ON of the four-way valves 2-1, 2-2, and 2-3 represents the case of connection in the direction of solid lines of the four-way valves in FIGS. 1 and 2, and OFF represents the case of connection in the direction of dotted lines. In addition, ON of the solenoid valves 10-1, 10-2, and 12-1 to 12-4 represents the case where the solenoid valves are opened and a refrigerant flows in the direction of arrows, and OFF represents the case where the solenoid valves are closed.

TABLE 1

| | | Heating | | |
|---|---|---|---|---|
| | | | Heating and defrosting operation | |
| Valve number | Cooling | Normal heating operation | 5-1: evaporator 5-2: defrosting | 5-1: defrosting 5-2: evaporator |
| 2-1 | OFF | ON | ON | ON |
| 2-2 | OFF | ON | ON | OFF |
| 2-3 | OFF | ON | OFF | ON |
| 4-b, 4-c | Outlet of indoor unit Refrigerant superheat control | Outlet of indoor unit Refrigerant subcooling control | Outlet of indoor unit Refrigerant subcooling control | Outlet of indoor unit Refrigerant subcooling control |
| 15 | Discharge temperature control | Discharge temperature control | Discharge temperature control | Discharge temperature control |
| 7-1 | Fully opened | Medium pressure control | Medium pressure control | Fully closed |
| 7-2 | Fully opened | Medium pressure control | Fully closed | Medium pressure control |
| 10-1, 10-2 | ON | OFF | OFF | OFF |
| 12-1 | OFF | OFF | OFF | ON |
| 12-2 | OFF | OFF | ON | OFF |
| 12-3 | OFF | OFF | OFF | ON |
| 12-4 | OFF | OFF | ON | OFF |

[Cooling Operation]

Figure 3:
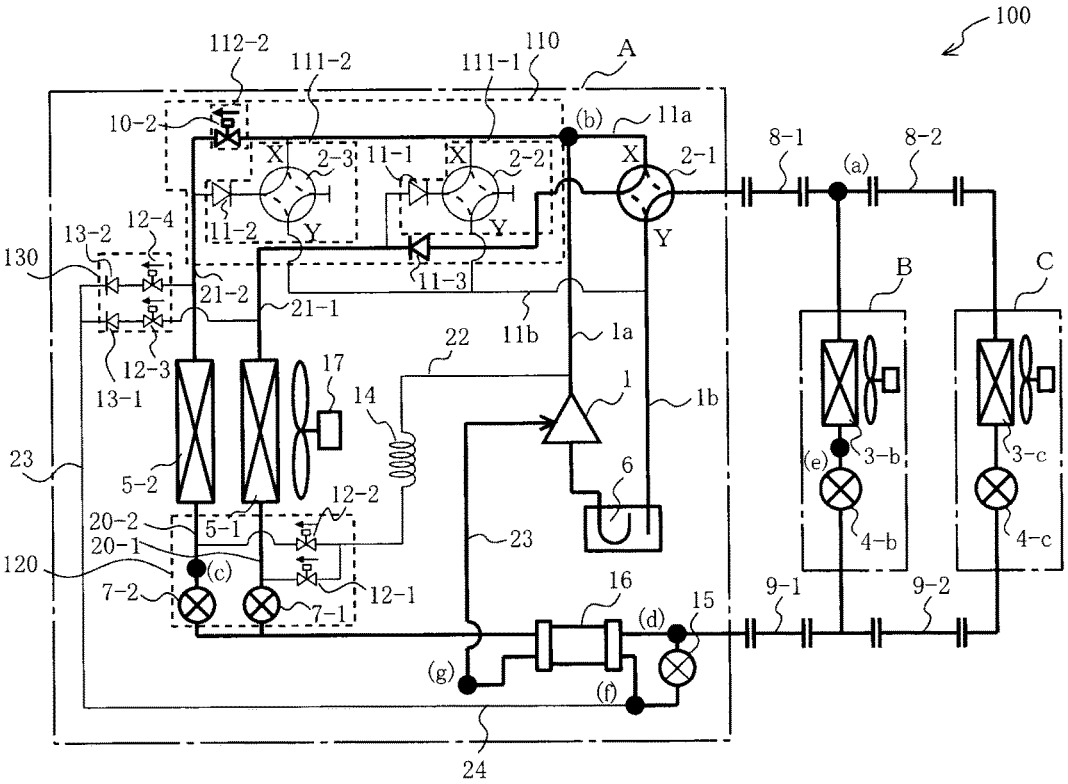
FIG. 3 is a diagram illustrating the flow of a refrigerant at the time of a cooling operation of the air-conditioning apparatus according to Embodiment 1 of the present invention.
Figure 4:
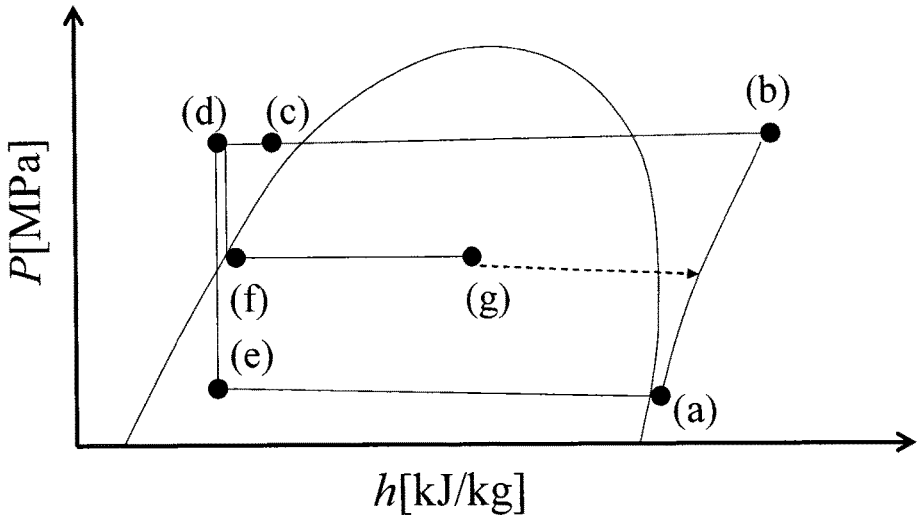
FIG. 4 is a P-h graph at the time of the cooling operation of the air-conditioning apparatus according to Embodiment 1 of the present invention.

FIG. 3 is a diagram illustrating the flow of a refrigerant at the time of a cooling operation of the air-conditioning apparatus of FIG. 2. In FIG. 3, parts in which a refrigerant flows during a cooling operation are represented by thick lines, and parts in which a refrigerant does not flow are represented by thin lines. FIG. 4 is a P-h graph representing the transition of a refrigerant in a cooling operation. Points (a) to (g) in FIG. 4 represent states of a refrigerant in parts denoted by the same signs in FIG. 3.

When the operation of the compressor 1 starts, a low-temperature low-pressure gas refrigerant is compressed by the compressor 1 and is discharged as a high-temperature high-pressure gas refrigerant. This refrigerant compression process at the compressor 1 is performed in such a manner that the refrigerant is heated more than when the refrigerant is adiabatically compressed based on an isentropic line by the adiabatic efficiency of the compressor 1, and is expressed by a line extending from the point (a) to the point (b) in FIG. 4.

The high-temperature high-pressure gas refrigerant that has been discharged from the compressor 1 is split into two refrigerant streams. One refrigerant stream passes through the four-way valve 2-1 and the check valve 11-3 and flows into the parallel heat exchanger 5-1 via the second connection pipe 21-1. The other refrigerant stream passes through the solenoid valve 10-2 and flows into the parallel heat exchanger 5-2 via the second connection pipe 21-2. The refrigerant that has flowed into the parallel heat exchangers 5-1 and 5-2 is cooled down while heating up the outdoor air and is turned into a medium-temperature high-pressure liquid refrigerant. In view of pressure loss at the outdoor heat exchanger 5, the change in the refrigerant at the parallel heat exchangers 5-1 and 5-2 is expressed by a slightly-slanted substantially horizontal straight line extending from the point (b) to the point (c) in FIG. 4. In the case where the operation capacity of the indoor units B and C is small, or the like, the solenoid valve 10-2 is closed so that a refrigerant does not flow to the parallel heat exchanger 5-2, resulting in a reduced transmission area of the outdoor heat exchanger 5. Thus, a stable cycle operation can be achieved.

The medium-temperature high-pressure liquid refrigerant streams that have flowed out of the parallel heat exchangers 5-1 and 5-2 flow into the first connection pipes 20-1 and 20-2, pass through the fully-opened second flow rate control devices 7-1 and 7-2, and then merge together. The merged refrigerant flows into the high-pressure side flow passage of the inner heat exchanger 16. Part of the refrigerant that has flowed out of the high-pressure side flow passage of the inner heat exchanger 16 is decompressed at the third flow rate control device 15, and then flows into the low-pressure side flow passage of the inner heat exchanger 16.

The inner heat exchanger 16 exchanges heat between the medium-temperature high-pressure liquid refrigerant that has flowed into the high-pressure side flow passage and the refrigerant that has been decompressed at the third flow rate control device 15 and flowed into the low-pressure side flow passage. At the inner heat exchanger 16, the refrigerant in the high-pressure side flow passage is cooled down by heat exchange with the refrigerant in the low-pressure side flow passage. This cooling process is expressed by a line extending from the point (c) to the point (d) in FIG. 4. In contrast, at the inner heat exchanger 16, the refrigerant in the low-pressure side flow passage changes from the point (f) to the point (g) in FIG. 4 and is injected into the compressor 1. The third flow rate control device 15 is controlled so that the compressor discharge temperature of the refrigerant after being injected is between about 70 degrees Centigrade and about 100 degrees Centigrade.

The high-pressure liquid refrigerant that has been cooled down at the inner heat exchanger 16 passes through the second extension pipes 9-1 and 9-2, flows into the first flow rate control devices **4-*b* and 4-*c*, where the refrigerant is expanded, decompressed, and turned into a low-temperature low-pressure, two-phase gas-liquid state. The change in the refrigerant at the first flow rate control devices 4-*b* and 4-*c* occurs with a constant enthalpy. The change in the refrigerant at this time is expressed by a vertical line extending from the point (d) to the point (e) in FIG. 4**.

The refrigerant in the low-temperature low-pressure, two-phase gas-liquid state that has flowed out of the first flow rate control devices **4-*b* and 4-*c* flows into the indoor heat exchangers 3-*b* and 3-*c*. The refrigerant that has flowed into the indoor heat exchangers 3-*b* and 3-*c* is heated up while cooling down the indoor air, and is turned into a low-temperature low-pressure gas refrigerant. The first flow rate control devices 4-*b* and 4-*c* are controlled so that the superheat (degree of superheat) of the low-temperature low-pressure gas refrigerant is between about 2 K and about 5 K. In view of pressure loss, the change in the refrigerant at the indoor heat exchangers 3-*b* and 3-*c* is expressed by a slightly-slanted substantially horizontal straight line extending from the point (e) to the point (a) in FIG. 4**.

The low-temperature low-pressure gas refrigerant that has flowed out of the indoor heat exchangers **3-*b* and 3-*c* passes through the first extension pipes 8-2 and 8-1, the four-way valve 2, and the accumulator 6, and flows into the compressor 1**, where the gas refrigerant is compressed.

[Normal Heating Operation]

Figure 5:
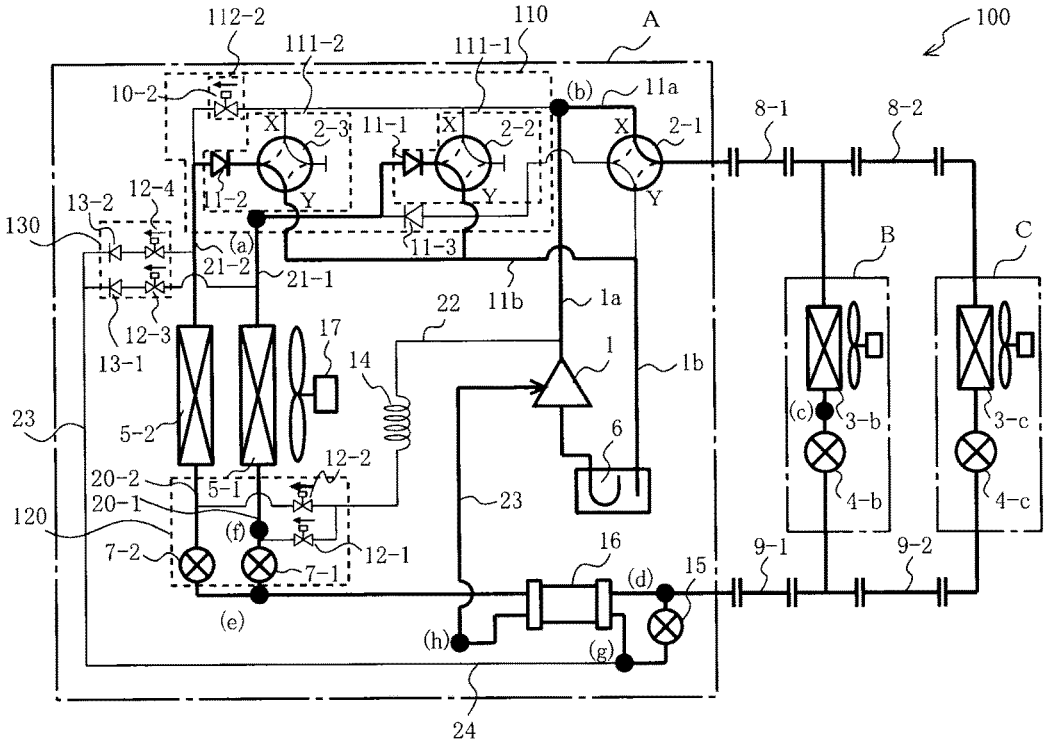
FIG. 5 is a diagram illustrating the flow of a refrigerant at the time of a normal heating operation of the air-conditioning apparatus according to Embodiment 1 of the present invention.
Figure 6:
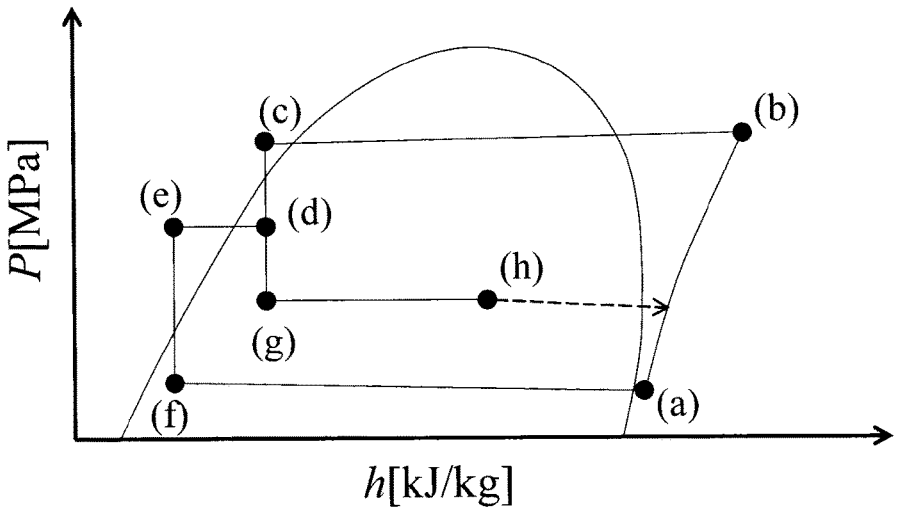
FIG. 6 is a P-h graph at the time of the normal heating operation of the air-conditioning apparatus according to Embodiment 1 of the present invention.

FIG. 5 is a diagram illustrating the flow of a refrigerant at the time of a normal heating operation of the air-conditioning apparatus of FIG. 2. In FIG. 5, parts in which a refrigerant flows during a normal heating operation are represented by thick lines, and parts in which a refrigerant does not flow are represented by thin lines. FIG. 6 is a P-h graph representing the transition of a refrigerant in a heating operation. Points (a) to (h) in FIG. 6 represent states of a refrigerant in parts denoted by the same signs in FIG. 5.

When the operation of the compressor 1 starts, a low-temperature low-pressure gas refrigerant is compressed by the compressor 1 and is discharged as a high-temperature high-pressure gas refrigerant. This refrigerant compression process at the compressor 1 is expressed by a line extending from the point (a) to the point (b) in FIG. 6.

The high-temperature high-pressure gas refrigerant that has been discharged from the compressor 1 passes through the four-way valve 2-1 and then flows out of the outdoor unit A. The high-temperature high-pressure gas refrigerant that has flowed out of the outdoor unit A flows into the indoor heat exchangers **3-*b* and 3-*c* of the indoor units B and C via the first extension pipes 8-1 and 8-2. The refrigerant that has flowed into the indoor heat exchangers 3-*b* and 3-*c* is cooled down while heating up the indoor air, and is turned into a medium-temperature high-pressure liquid refrigerant. The change in the refrigerant at the indoor heat exchangers 3-*b* and 3-*c* is expressed by a slightly-slanted substantially horizontal straight line extending from the point (b) to the point (c) in FIG. 6**.

The medium-temperature high-pressure liquid refrigerant that has flowed out of the indoor heat exchangers **3-*b* and 3-*c* flows into the first flow rate control devices 4-*b* and 4-*c*, where the refrigerant is expanded, decompressed, and turned into a medium-pressure, two-phase gas-liquid state. The change in the refrigerant at this time is expressed by a vertical line extending from the point (c) to the point (d) in FIG. 6. The first flow rate control devices 4-*b* and 4-*c*** are controlled so that the subcooling (degree of subcooling) of the medium-temperature high-pressure liquid refrigerant is between about 5 K and about 20 K.

The refrigerant in the medium-pressure, two-phase gas-liquid state that has flowed out of the first flow rate control devices **4-*b* and 4-*c* returns to the outdoor unit A via the extension pipes 9-2 and 9-1. The refrigerant that has returned to the outdoor unit A flows into the high-pressure side flow passage of the inner heat exchanger 16. Part of the refrigerant that has returned to the outdoor unit A flows away, for the purpose of injection, from the main circuit, is decompressed at the third flow rate control device 15 (the point (d)→the point (g) in FIG. 6), and flows into the low-pressure side flow passage of the inner heat exchanger 16**.

The inner heat exchanger 16 exchanges heat between the refrigerant that has flowed into the high-pressure side flow passage and the refrigerant that has been decompressed at the third flow rate control device 15 and flowed into the low-pressure side flow passage. At the inner heat exchanger 16, the refrigerant in the high-pressure side flow passage is turned into liquid by heat exchange with the refrigerant in the low-pressure side flow passage. The change in the refrigerant at this time is expressed by a line extending from the point (d) to the point (e) in FIG. 6. In contrast, at the inner heat exchanger 16, the refrigerant in the low-pressure side flow passage changes from the point (g) to the point (h) in FIG. 6 by being heated up by the heat exchange with the refrigerant in the high-pressure side flow passage, and is injected into the compressor 1. The third flow rate control device 15 is controlled so that the compressor discharge temperature of the refrigerant after being injected is between about 70 degrees Centigrade and about 100 degrees Centigrade.

The refrigerant in the main circuit that has passed through the high-pressure side flow passage of the inner heat exchanger 16 is split into two refrigerant streams and the refrigerant streams flow into the first connection pipes 20-1 and 20-2. The refrigerant streams that have flowed into the first connection pipes 20-1 and 20-2 are expanded, decompressed, and turned into a low-pressure, two-phase gas-liquid state by the second flow rate control devices 7-1 and 7-2. The change in the refrigerant at this time is expressed by a line extending from the point (e) to the point (f) in FIG. 6. The second flow rate control devices 7-1 and 7-2 are controlled so that the medium-pressure saturation temperature of the extension pipe 9-1 or the like is between about 0 degrees Centigrade and about 20 degrees Centigrade.

The refrigerant streams that have flowed out of the second flow rate control devices 7-1 and 7-2 flow into the parallel heat exchangers 5-1 and 5-2, are heated up while cooling down the outside air, and are turned into low-temperature low-pressure gas refrigerant streams. The change in the refrigerant at the parallel heat exchangers 5-1 and 5-2 is expressed by a slightly-slanted substantially horizontal straight line extending from the point (f) to the point (a) in FIG. 6. The low-temperature low-pressure gas refrigerant streams that have flowed out of the parallel heat exchangers 5-1 and 5-2 flow into the second connection pipes 21-1 and 21-2, pass through the check valves 11-1 and 11-2 and the four-way valves 2-2 and 2-3, and then merge together. The merged refrigerant passes through the accumulator 6, flows into the compressor 1, and is compressed.

[Heating and Defrosting Operation (Continuous Heating Operation)]

A heating and defrosting operation is performed in the case where frost is deposited on the outdoor heat exchanger 5 during a normal heating operation. The determination of whether or not frost has been deposited is performed, for example, by a method of determining whether a saturation temperature converted from compressor suction pressure has been significantly lowered than a specific outside air temperature.

In a heating and defrosting operation, between the case where the parallel heat exchanger 5-2 performs defrosting and the parallel heat exchanger 5-1 functions as an evaporator and continues to perform heating, and the contrary case where the parallel heat exchanger 5-2 functions as an evaporator and continues to perform heating and the parallel heat exchanger 5-1 performs defrosting, the difference is only in that the flow of a refrigerant in the parallel heat exchanger 5-1 and the flow of a refrigerant in the parallel heat exchanger 5-2 are opposite to each other by the second flow switching unit 120 and the third flow switching unit 130. Hereafter, an operation in the case where the parallel heat exchanger 5-2 performs defrosting and the parallel heat exchanger 5-1 functions as an evaporator and continues to perform heating, will be explained below.

Figure 7:
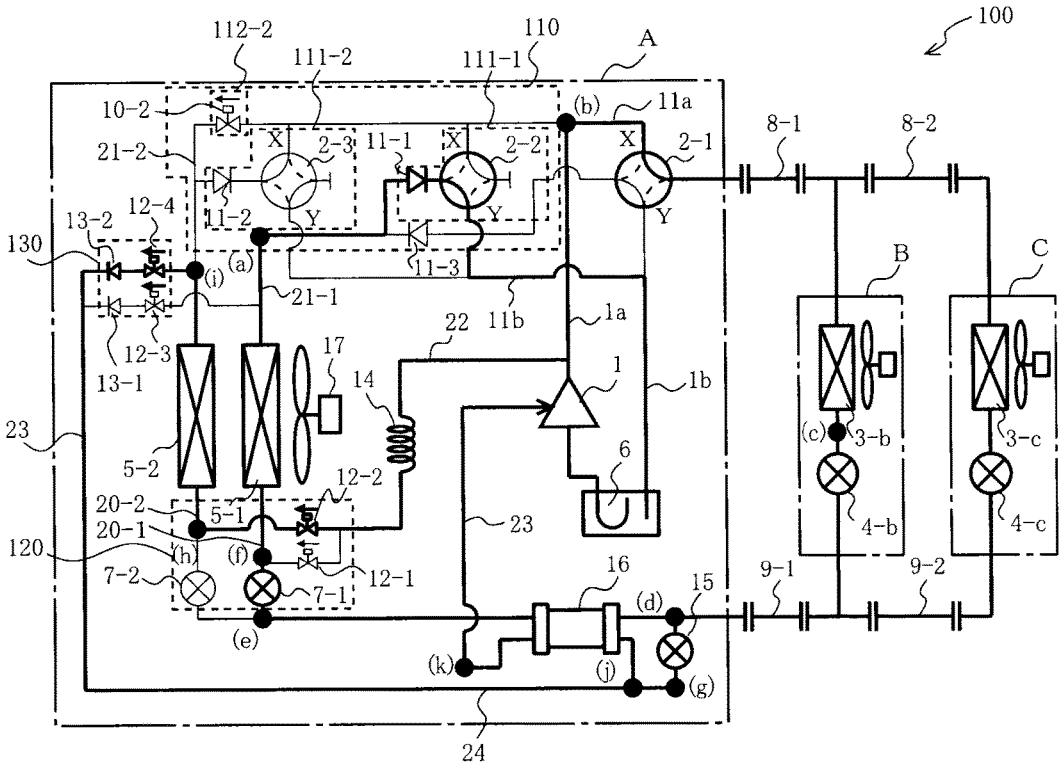
FIG. 7 is a diagram illustrating the flow of a refrigerant at the time of a heating and defrosting operation of the air-conditioning apparatus according to Embodiment 1 of the present invention.
Figure 8:
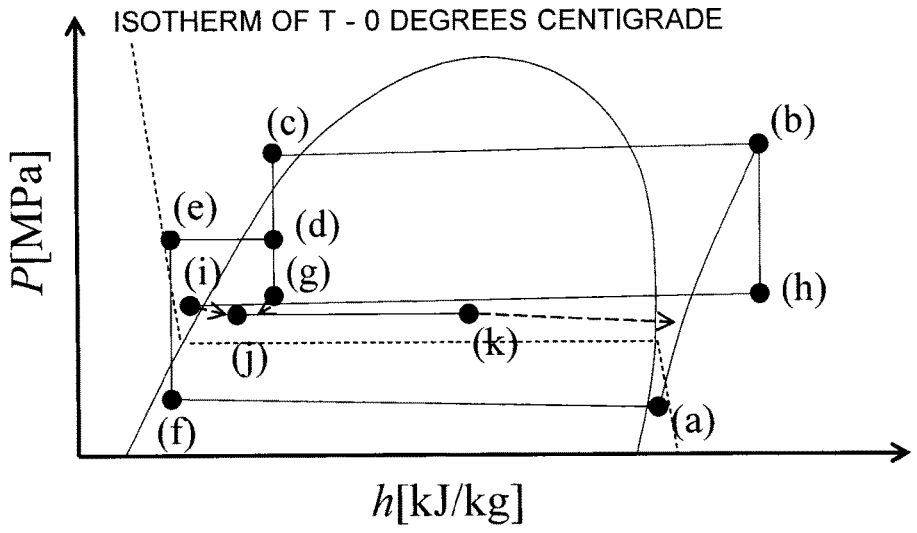
FIG. 8 is a P-h graph at the time of the heating and defrosting operation of the air-conditioning apparatus according to Embodiment 1 of the present invention.

FIG. 7 is a diagram illustrating the flow of a refrigerant at the time of a heating and defrosting operation of the air-conditioning apparatus of FIG. 2. In FIG. 7, parts in which a refrigerant flows during a heating and defrosting operation are represented by thick lines, and parts in which a refrigerant does not flow are represented by thin lines. FIG. 8 is a P-h graph representing the transition of a refrigerant in a heating and defrosting operation. Points (a) to (k) in FIG. 8 represent states of a refrigerant in parts denoted by the same signs in FIG. 7.

In the case where it is detected that defrosting for resolving a frost formation state needs to be performed during execution of a normal heating operation, a controller (not illustrated) closes the second flow rate control device 7-2, which is proximity to the parallel heat exchanger 5-2 to be subjected to defrosting, in the second flow switching unit 120. Then, the controller (not illustrated) further disconnects the four-way valve 2-3, which has been connected to the parallel heat exchanger 5-2, in the first flow switching unit 110. Accordingly, the parallel heat exchanger 5-2 is disconnected from the main circuit.

Then, the controller (not illustrated) opens the solenoid valve 12-2 in the second flow switching unit 120 and the solenoid valve 12-4 in the third flow switching unit 130. Accordingly, a medium-pressure defrost circuit, in which the compressor 1, the expansion device 14, the solenoid valve 12-2, the parallel heat exchanger 5-2, the solenoid valve 12-4, the check valve 13-2, the inner heat exchanger 16, and the injection port of the compressor 1 are connected in that order, is opened, and a heating and defrosting operation is started.

Part of the high-temperature high-pressure gas refrigerant that has been discharged from the compressor 1 flows into the medium-pressure defrost circuit, and is decompressed into medium-pressure at the expansion device 14. The change in the refrigerant at this time is expressed by a line extending from the point (b) to the point (h) in FIG. 8. The refrigerant that has been decompressed into medium-pressure passes through the solenoid valve 12-2, and flows into the parallel heat exchanger 5-2. The refrigerant that has flowed into the parallel heat exchanger 5-2 is cooled down by exchanging heat with frost deposited on the parallel heat exchanger 5-2. Accordingly, by causing the high-temperature high-pressure gas refrigerant that has been discharged from the compressor 1 to flow into the parallel heat exchanger 5-2, frost deposited on the parallel heat exchanger 5-2 can be melted. The change in the refrigerant at this time is expressed by a line extending from the point (h) to the point (i) in FIG. 8.

The refrigerant used for defrosting is at a saturation temperature within a range between about 0 degrees Centigrade and about 10 degrees Centigrade, which is equal to or higher than the frost temperature (0 degrees Centigrade). The refrigerant that has been used for defrosting passes through the solenoid valve 12-4 and the check valve 13-2, merges (point (j)) with the refrigerant (point (g)) that has flowed away from the main circuit and has been decompressed at the third flow rate control device 15. The merged refrigerant is heated up (point (k)) at the inner heat exchanger 16, and is injected via the injection port of the compressor 1. The check valve 13-1 prevents the refrigerant that has flowed out of the parallel heat exchanger 5-2, which is being subjected to defrosting, from flowing backward to the parallel heat exchanger 5-1, which functions as an evaporator.

In execution of injection, injection is made not to the suction side of the compressor 1 but in the middle of the compression process at the compressor 1. If injection is made to the suction side of the compressor 1, the pressure of the refrigerant to be used for defrosting needs to be reduced to the suction pressure by the expansion device 14. However, by making injection in the middle of the compression process at the compressor 1 as in this example, there is no need to reduce the pressure of the refrigerant to be used for defrosting to the suction pressure. By performing such medium-pressure defrosting, the compressor 1 only needs to increase the pressure of the refrigerant from low pressure to high pressure, which circulating in the main circuit for the purpose of heating, and the pressure of the medium-pressure, two-phase gas-liquid refrigerant that has been subjected to injection only needs to be increased from medium pressure to high pressure. Thus, the amount of load on the compressor 1 is reduced, and the efficiency (heating capacity/amount of load on the compressor) of a heat pump is improved, thereby contributing to the energy conservation effect.

The flow of a refrigerant in individual operations is clearly explained above. Now, features of the first flow switching unit 110 and the third flow switching unit 130 for switching connection on the compressor sides of the parallel heat exchangers 5-1 and 5-2 will be explained.

(First Flow Switching Unit 110)

As described above, although four-way valves and three-way valves are generally available in the market, their Cv values are in a wider range than those of solenoid valves and their costs are less expensive than solenoid valves. Therefore, if four-way valves or three-way valves are able to be used instead of known bidirectional solenoid valves for implementation of medium-pressure defrosting, the range of selection of a Cv value is widened, which enables cost reduction. In addition, with a circuit configuration in which a low-pressure low-density refrigerant which is susceptible to pressure loss passes through not a solenoid valve having a small Cv value but a four-way valve or a three-way valve, a reduction in pressure loss may be expected.

First, in order to be able to use a four-way valve or three-way vale, in the first flow switching unit 110, the four-way valves 2-2 and 2-3 are connected to the high-pressure pipe 11*a*, which branches off from the discharge pipe 1*a*, and the low-pressure pipe 11*b*, which branches off from the suction pipe 1*b*, respectively. Accordingly, high pressure and low pressure of the four-way valves 2-2 and 2-3 can be fixed.

Then, with the check valves 11-1 and 11-2, a flow passage in which only a refrigerant that has flowed out of a parallel heat exchanger functioning as an evaporator and returned to the suction side of the compressor 1 passes through the four-way valves 2-2 and 2-3 during a normal heating operation and a heating and defrosting operation, is formed. A refrigerant that has flowed out of a parallel heat exchanger functioning as an evaporator and returned to the suction side of the compressor 1, especially, has a low pressure and low density, and is susceptible to pressure loss. Therefore, with the configuration in which such a refrigerant passes through the four-way valves 2-2 and 2-3, a four-way valve having a Cv value greater than a solenoid valve can be selected, and a reduction in the pressure loss can thus be achieved. Similarly, an increase in the bore regarding a Cv value of the check valves 11-1 and 11-2 can also be achieved.

Further, the solenoid valves (unidirectional solenoid valves) 10-1 and 10-2 are provided at pipes (pipes between the high-pressure pipe 11*a* and the second connection pipes 21-1 and 21-2) through which a gas refrigerant passes during a cooling operation. Since a gas refrigerant has a large pressure loss at the time when passing through a pipe and a valve, it is preferable that a valve having a large Cv value is provided. However, there is a tendency that the larger the Cv value, the higher the cost. Therefore, a refrigerant passing through the solenoid valves 10-1 and 10-2 is as represented by the point (b) in FIG. 4, has a high pressure and a medium degree of refrigerant density, and is less susceptible to pressure loss than low-pressure gas among gas refrigerants. Thus, a valve having a "large" Cv value, which requires high cost, is not necessarily used, and a unidirectional solenoid valve of a "medium" Cv value can be used.

(Third Flow Switching Unit 130)

Since a liquid refrigerant is less susceptible to pressure loss at the time of passing through a valve, solenoid valves 12-3 and 12-4 having a small Cv value can be selected and used for the second bypass pipe 23 through which a small amount of liquid refrigerant after being used for defrosting passes. By replacing the solenoid valves 12-3 and 12-4 with, for example, flow rate control devices having a small Cv value and adjusting the defrosting capacity, more detailed defrost control can be performed.

As described above, in Embodiment 1, four-way valves and solenoid valves which match the characteristics of a flowing refrigerant are adopted. Thus, a refrigerant circuit configuration which achieves a reduction in cost can be attained.

Next, features of the second flow switching unit 120 will be explained.

(Second Flow Switching Unit 120)

Both during cooling and heating, a high-pressure high-density liquid refrigerant that has flowed out of a condenser flows to the first connection pipes 20-1 and 20-2. Thus, flow rate control devices 7-1 and 7-2, which correspond to the bidirectional flow of a refrigerant and are capable of controlling the flow rate, can be used, although the flow rate control devices 7-1 and 7-2 have a small Cv value. Since a refrigerant may be expanded at the solenoid valves 12-1 and 12-2, instead of by the expansion device 14, even at the time of defrosting, the solenoid valves 12-1 and 12-2, which are small in size, can be used. Thus, a refrigerant circuit configuration which matches the characteristics of a flowing refrigerant can be achieved.

Finally, a control flow for implementing the above-described operations will be explained.

Regarding division of the outdoor heat exchanger 5, in the case where the outdoor heat exchanger 5 is divided into vertically aligned portions to form the parallel heat exchangers 5-1 and 5-2 as described above, water generated by defrosting on the parallel heat exchanger arranged on an upper side, falls on the lower parallel heat exchanger operating as an evaporator. Therefore, in the case where the outdoor heat exchanger 5 is divided into vertically aligned portions, although pipe connection is more simplified than the case where the outdoor heat exchanger 5 is divided right and left, there is a possibility that ice is formed on the lower parallel heat exchanger. Thus, control for performing defrosting in the order of the upper side and then the lower side so as not to form ice in the case where the parallel heat exchanger 5-2 is arranged above the parallel heat exchanger 5-1, will be explained.

[Control Flow]

Figure 9:
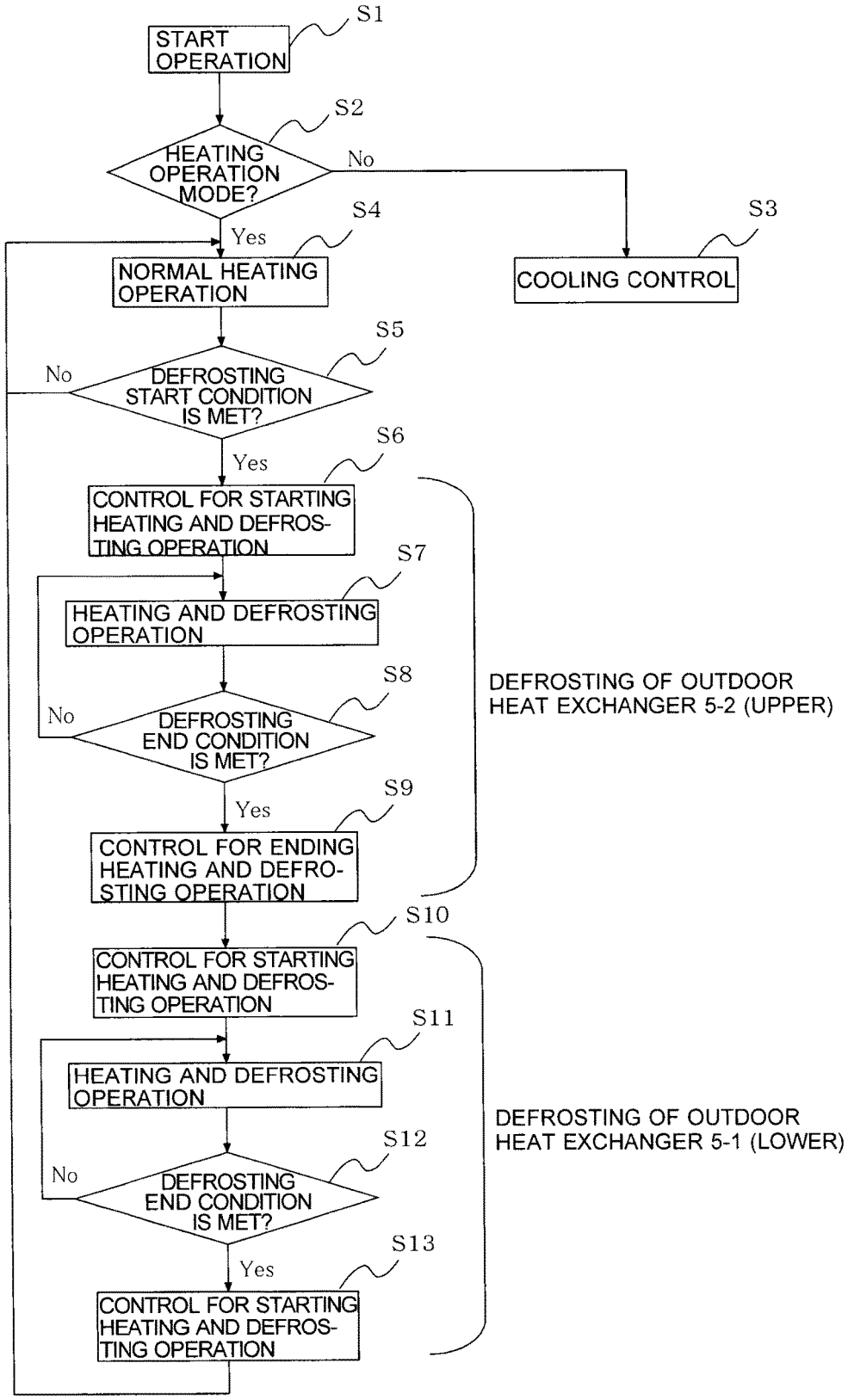
FIG. 9 is a control flow of the air-conditioning apparatus according to Embodiment 1 of the present invention.

FIG. 9 is a diagram illustrating a control flow of the air-conditioning apparatus of FIG. 1.

When an operation is started (S1), a determination is made as to whether a cooling operation or a heating operation is being performed based on operation modes of the indoor units B and C (S2), and control of a normal cooling operation (S3) or a normal heating operation (S4) is performed. During a heating operation, a determination as to whether or not a defrosting start condition represented by expression (1) is met (that is, whether frost is deposited or not), is performed (S5).

$$\text{(Saturation temperature of suction pressure)} < \text{(Outside air temperature)} - x1 \quad (1),$$

where x1 may be set between about 10 K and about 20 K.

When expression (1) is met, a heating and defrosting operation is started (S6). At this time, defrosting is started first from the upper parallel heat exchanger 5-2 of the outdoor heat exchanger 5. ON/OFF states of individual valves in a normal heating operation prior to a heating and defrosting operation are represented in fields for "heating and defrosting operation" in Table 1. From the states, the states of the individual valves are changed as represented in fields for "5-1: evaporator 5-2: defrosting" in "heating and defrosting operation" in Table 1, and a heating and defrosting operation is started. More specifically, the parallel heat exchanger 5-2 is disconnected from the main circuit as described above by operations (a) and (b) described below, and defrosting is started by operations of (c) and (d) described below (S6).

(a) Second flow rate control device 7-2: close (b) Four-way valve 2-3: OFF (c) Solenoid valve 12-4: open (d) Solenoid valve 12-2: open Until frost on the parallel heat exchanger 5-2 that is subjected to defrosting is melted and a defrosting end condition is met, a heating and defrosting operation in which defrosting of the parallel heat exchanger 5-2 is performed and the parallel heat exchanger 5-1 is caused to operate as an evaporator, is performed (S7, S8). When the heating and defrosting operation continues to be performed and frost deposited on the parallel heat exchanger 5-2 starts to be melted, the temperature of a refrigerant in the second bypass pipe 23 increases. Therefore, as the defrosting end condition, for example, a temperature sensor is mounted at the second bypass pipe 23, and when the temperature of the sensor exceeds a threshold as represented by expression (2), it may be determined that defrosting should be ended.

$$(\text{Temperature of refrigerant at injection pipe}) > x2 \quad (2),$$

where x2 may be set between 5 degrees Centigrade and 10 degrees Centigrade.

When expression (2) is met, the heating and defrosting operation for performing defrosting of the parallel heat exchanger 5-2 is ended (S9). More specifically, defrosting of the parallel heat exchanger 5-2 is ended by operations (a) and (b) described below, and the parallel heat exchanger 5-2 is reconnected to the main circuit by operations (c) and (d) described below.

(a) Solenoid valve 12-4: close (b) Solenoid valve 12-2: close (c) Four-way valve 2-3: ON (d) Second flow rate control device 7-2: normal medium pressure control Then, the states of the individual valves are changed to the states represented in fields for "5-1: defrosting 5-2: evaporator" in "heating and defrosting operation" in Table 1, and a heating and defrosting operation for performing defrosting of the parallel heat exchanger 5-1 is started. Since (S10) to (S13) differ from (S6) to (S9) only in valve numbers, explanation for (S10) to (S13) will be omitted.

As described above, by performing defrosting in the order of the upper parallel heat exchanger 5-2 and then the lower parallel heat exchanger 5-1 of the outdoor heat exchanger 5, formation of ice can be prevented. When defrosting of both the upper parallel heat exchanger 5-2 and the lower parallel heat exchanger 5-1 is completed and the heating and defrosting operation of (S6) to (S13) is ended, the process returns to the normal heating operation of (S4).

As explained above, according to Embodiment 1, a heating and defrosting operation is able to continuously heat a room while performing defrosting, and has additional advantages as described below. That is, the four-way valves 2-2 and 2-3 are connected to the high-pressure pipe 11*a*, which branches off from the discharge pipe 1*a*, and the low-pressure pipe 11*b*, which branches off from the suction pipe 1*b*, respectively. With this configuration, high pressure and low pressure can be fixed. In addition, in the first flow switching unit 110, the four-way valves 2-2 and 2-3 or three-way valves and the unidirectional solenoid valves 10-1 and 10-2 having simple configurations can be used. Thus, medium-pressure defrosting capable of high-efficiency defrosting can be achieved at low cost.

Further, among four-way valves, unidirectional solenoid valves, and bidirectional solenoid valves which are generally available in the market, the maximum Cv values decrease in the order of four-way valves, unidirectional solenoid valves, and bidirectional solenoid valves, and the price tends to increase in that order. In Embodiment 1, four-way valves and unidirectional valves are appropriately selected, in accordance with the characteristics of a flowing refrigerant, to form the first flow switching unit 110, without using bidirectional solenoid valves.

Furthermore, the solenoid valves 12-3 and 12-4, which have a small Cv value, can be selected and used for the third flow switching unit 130. Thus, cost can be reduced compared to the case where a solenoid valve having a large Cv value is used.

Further, four-way valves and unidirectional solenoid valves are appropriately selected, in accordance with the characteristics of a flowing refrigerant, to form the second flow switching unit 120, without using bidirectional solenoid valves.

Embodiment 2

In Embodiment 2, all the valves in the first flow switching unit 110 and the second flow switching unit 120 in Embodiment 1 are four-way valves.

Figure 10:
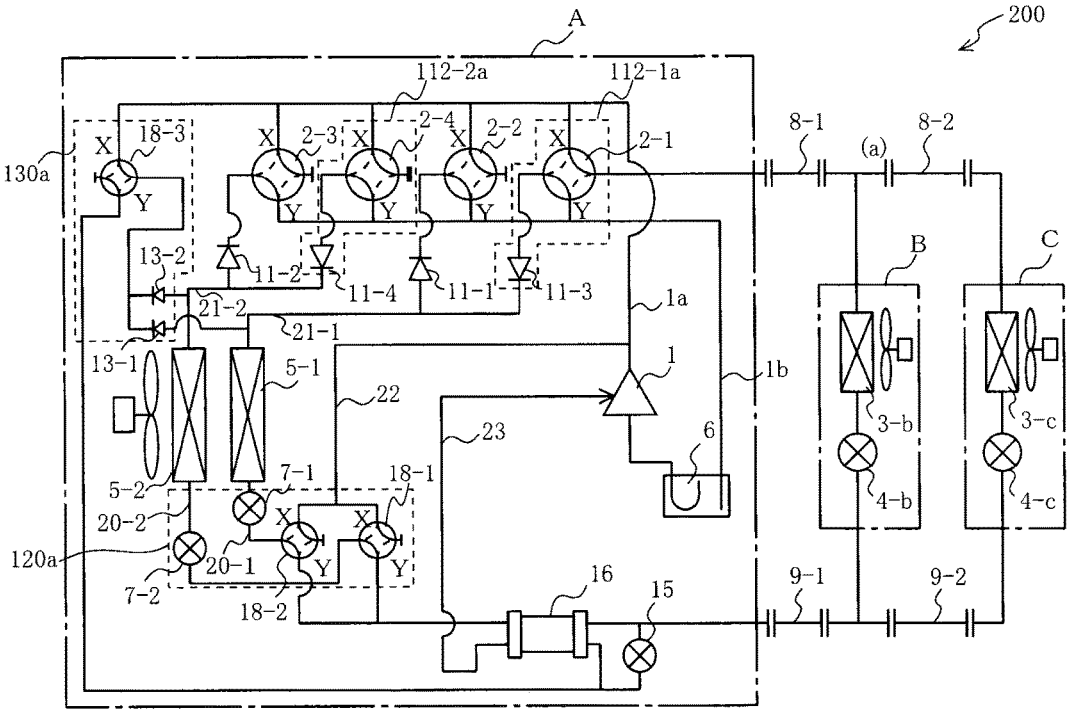
FIG. 10 is a refrigerant circuit diagram illustrating a refrigerant circuit configuration of an air-conditioning apparatus according to Embodiment 2 of the present invention.

FIG. 10 is a refrigerant circuit diagram illustrating a refrigerant circuit configuration of an air-conditioning apparatus 200 according to Embodiment 2 of the present invention. Parts of Embodiment 2 which are different from Embodiment 1 will be mainly explained below.

In the air-conditioning apparatus 200, as the second connection switching devices 112-1 and 112-2 in Embodiment 1, the solenoid valves 10-1 and 10-2 are replaced with switching devices 112-1*a* and 112-2*a* described below. That is, in the switching devices 112-1*a* and 112-2*a*, check valves 11-3 and 11-4 are connected in series to third ports of four-way valves 2-1 and 2-4 whose first ports (high-pressure ports) X are connected to the high-pressure pipe 11*a* and second ports (low-pressure ports) Y are connected to the low-pressure pipe 11*b* so that a refrigerant flows only from the four-way valves 2-1 and 2-4 to the second connection pipes.

The air-conditioning apparatus 200 further includes a second flow switching unit 120*a*, instead of the second flow switching unit 120 in Embodiment 1. In the second flow switching unit 120*a*, four-way valves 18-1 and 18-2 are used, instead of the solenoid valves 12-1 and 12-2 of the second flow switching unit 120. In the four-way valves 18-1 and 18-2, first ports (high-pressure ports) X are connected to the first bypass pipe 22, second ports (low-pressure ports) Y are connected to the main pipe extending from the first flow rate control devices 4-*a* and 4-*b* toward the parallel heat exchangers 5-1 and 5-2 in the main circuit, and the connection destinations of the first connection pipes 20-1 and 20-2 are changed to the first bypass pipe 22 or the main pipe. The four-way valves 2-4, 18-1, and 18-2 may be three-way valves.

Further, the air-conditioning apparatus 200 includes a third flow switching unit 130*a*, instead of the third flow switching unit 130 in Embodiment 1. The third flow switching unit 130*a* includes a four-way valve 18-3 and the check valves 13-1 and 13-2. In the four-way valve 18-3, a first port (high pressure) is connected to the high-pressure pipe 11*a*, and a second port (low-pressure port) is connected to a part of the second bypass pipe 23 that is not divided into branch pipes. The check valves 13-1 and 13-2 are connected in series to a third port of the four-way valve 18-3 so that a refrigerant flows only from the second connection pipes 21-1 and 21-2 side to the second bypass pipe 23. The four-way valve 18-3 may be a three-way valve.

Table 2 provided below illustrates ON/OFF and opening degree adjustment control of individual valves in individual operations of the air-conditioning apparatus 200 in FIG. 10. In Table 2, ON of the four-way valves 2-1, 2-2, 2-3, 2-4, 18-1, 18-2, and 18-3 represents the case of connection in the direction of solid lines of the four-way valves in FIG. 10, and OFF represents the case of connection in the direction of dotted lines. During defrosting, the second flow rate control devices 7-1 and 7-2 act as the expansion device 14 in FIG. 1 and reduce the pressure of a refrigerant from high pressure to medium pressure. "Fix opening degree" in Table 2 represents fixing to a preset opening degree so that defrost capacity can be exhibited. Instead of fixing an opening degree, the opening degree may be changed according to the outside air temperature or the like.

TABLE 2

| | | Heating | | |
|---|---|---|---|---|
| | | | Heating and defrosting operation | |
| Valve number | Cooling | Normal heating operation | 5-1: evaporator 5-2: defrosting | 5-1: defrosting 5-2: evaporator |
| 2-1 | OFF | ON | ON | ON |
| 2-2 | OFF | ON | ON | OFF |
| 2-3 | OFF | ON | OFF | ON |
| 2-4 | OFF | ON | ON | ON |
| 4-b, 4-c | Outlet of indoor unit Refrigerant superheat control | Outlet of indoor unit Refrigerant subcooling control | Outlet of indoor unit Refrigerant subcooling control | Outlet of indoor unit Refrigerant subcooling control |
| 15 | Discharge temperature control | Discharge temperature control | Discharge temperature control | Discharge temperature control |
| 7-1 | Fully opened | Medium pressure control | Medium pressure control | Fix opening degree |
| 7-2 | Fully opened | Medium pressure control | Fix opening degree | Medium pressure control |
| 18-1 | ON | ON | OFF | ON |
| 18-2 | ON | ON | ON | OFF |
| 18-3 | ON | ON | OFF | OFF |

The Cv values of the four-way valves 2-2, 2-3, and 2-4 are available in a wide range from a size for room air-conditioners to a size of air-conditioning equipment for buildings. Therefore, a valve may be selected according to the state of a refrigerant. In addition, since a circuit switching of the second flow switching unit 120 for the outdoor heat exchanger 5 is performed using the four-way valves 18-1 and 18-2, the expansion device 14 may be omitted, and expansion of a refrigerant at the time of defrosting can be adjusted by the second flow rate control device 7-1 or 7-2.

As explained above, according to Embodiment 2, effects similar to those in Embodiment 1 can be achieved.

In Embodiment 1 and Embodiment 2 described above, the outdoor heat exchanger 5 is divided into vertically aligned portions to form the parallel heat exchangers 5-1 and 5-2, and defrosting of the parallel heat exchangers 5-1 and 5-2 is performed in the order of the upper parallel heat exchanger and then the lower parallel heat exchanger during a heating and defrosting operation. Therefore, formation of ice can be prevented.

Figure 11:
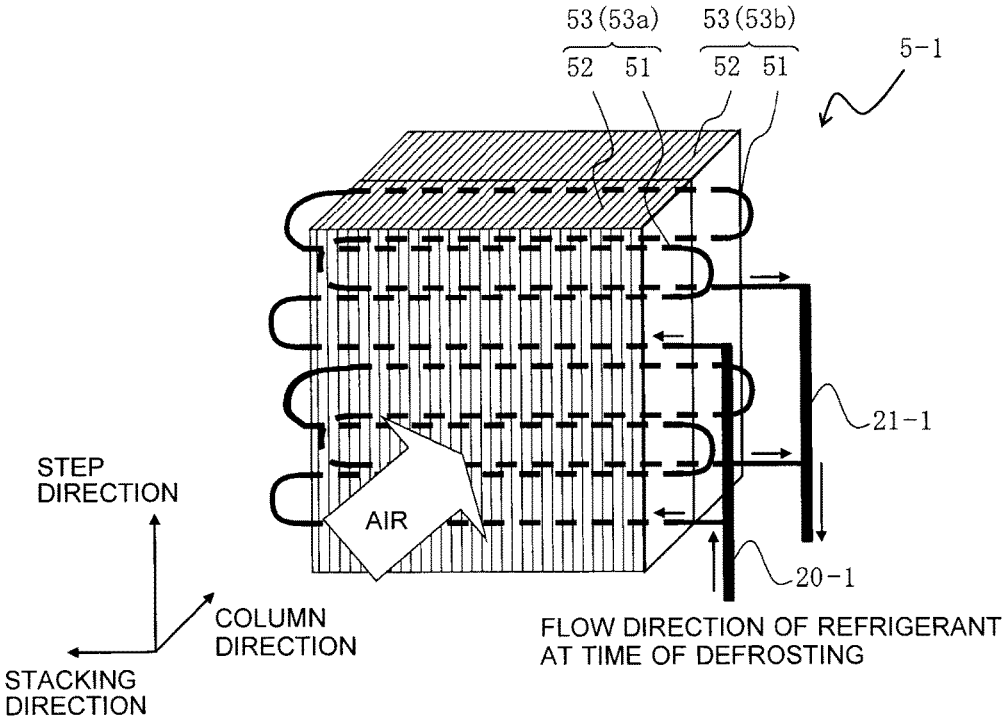
FIG. 11 is a diagram illustrating a structure of a parallel heat exchanger in an outdoor heat exchanger of the air-conditioning apparatuses according to Embodiment 1 and Embodiment 2 of the present invention.

As a specific structure of the outdoor heat exchanger 5, a heat exchanger having the structure illustrated in FIG. 11 can be adopted. FIG. 11 illustrates the parallel heat exchanger 5-1, which is obtained by division. The parallel heat exchanger 5-2 has a similar structure. The parallel heat exchanger 5-1 has a structure in which plural (in this case, two) heat exchange parts 53 are arranged in a column direction, which is an air passing direction. The heat exchange parts 53 each include plural heat transmission pipes 51 through which a refrigerant passes and which are arranged in a step direction, which is vertical relative to the air passing direction, and plural fins 52 arranged with spaces therebetween so that air passes in the air passing direction.

In FIG. 11, arrows illustrated near the first connection pipe 20-1 and the second connection pipe 21-1 each represent the flow of a refrigerant at the time of defrosting, and the refrigerant is caused to flow in from a heat exchange part 53*a* on the upwind side of the air passing direction. As a specific structure, the first connection pipe 20-1 is connected to the heat exchange part 53*a* on the upwind side of the air passing direction, and the second connection pipe 21-1 is connected to a heat exchange part 53*b* on the downwind side of the air passing direction. Accordingly, during defrosting, a refrigerant flows in from the heat exchange part 53*a* on the upwind side of the air passing direction, and then the refrigerant flows into the heat exchange part 53*b* on the downwind side. Therefore, even if heat of a refrigerant at the heat exchange part 53*a*, which is on the upwind side into which a high-temperature refrigerant first flows, is transferred to the air during defrosting, the heat transferred to the air is transmitted to frost on the heat exchange part 53*b* on the downwind side, thereby high-efficiency defrosting being achieved.

Furthermore, in the parallel heat exchangers 5-1 and 5-2, by setting the spaces between the fins of the heat exchange part 53*a* on the upwind side to be wider than the spaces between the fins of the heat exchange part 53*b* on the downwind side, the amount of heat transferred at the heat exchange part 53*a* on the upwind side can be efficiently transmitted to the heat exchange part 53*b* on the downwind side, thereby high-efficiency defrosting being achieved. The structure of the outdoor heat exchanger 5 is not limited to the structure including plural columns as illustrated in FIG. 11. The outdoor heat exchanger 5 may have a structure of one column.

Normally, in execution of defrosting, the outdoor fan 17 is stopped, so that the amount of heat transferred to the air is reduced. However, with this structure, even with a single outdoor fan 17 which conveys air to the parallel heat exchangers 5-1 and 5-2, defrosting can be performed without stopping the outdoor fan 17. Therefore, the heat exchange capacity of a parallel heat exchanger operating as an evaporator can be maintained.

In the case where outdoor fans are installed on the individual parallel heat exchangers 5-1 and 5-2, by stopping an outdoor fan on the side for which defrosting is performed, the amount of heat to be transferred to the air can be reduced, thereby high-efficiency defrosting can be achieved.

Furthermore, in Embodiment 1 and Embodiment 2, part of a refrigerant that has flowed out of the first flow rate control devices 4-*b* and 4-*c* takes a detour to the third flow rate control device 15, passes through the inner heat exchanger 16, and then is injected to the compressor 1. Therefore, effects described below can be achieved. That is, by cooling down a refrigerant in the main circuit through heat exchange at the inner heat exchanger 16 with a refrigerant whose pressure has been reduced at the third flow rate control device 15, the enthalpy of the refrigerant in the main circuit is reduced, and the refrigerant efficiency can be increased by the reduction of the enthalpy. Thus, an effect of improving the heating capacity can be achieved.

REFERENCE SIGNS LIST

1: compressor, 1*a*: discharge pipe, 1*b*: suction pipe, 2-1: cooling/heating switching device (four-way valve), 2-2: high/low pressure switching device (four-way valve), 2-3: high/low pressure switching device (four-way valve), 2-4: four-way valve, 3-*b*: indoor heat exchanger, 3-*c*: indoor heat exchanger, 4-*b*: first flow rate control device, 4-*c*: first flow rate control device, 5-1: parallel heat exchanger, 5-2: parallel heat exchanger, 5: outdoor heat exchanger, 6: accumulator, 7-1: second flow rate control device, 7-2: second flow rate control device, 8-1: extension pipe, 8-2: extension pipe, 9-1: extension pipe, 9-2: extension pipe, 10-1: solenoid valve, 10-2: solenoid valve, 11-1: check valve, 11-2: check valve, 11*a*: high-pressure pipe, 11*b*: low-pressure pipe, 12-1: solenoid valve, 12-2: solenoid valve, 13-1: check valve, 13-2: check valve, 14: expansion device, 15: third flow rate control device, 16: inner heat exchanger, 17: outdoor fan, 18-1: four-way valve, 18-2: four-way valve, 18-3: four-way valve, 20-1: first connection pipe, 20-2: first connection pipe, 21-1: second connection pipe, 21-2: second connection pipe, 22: first bypass pipe, 23: second bypass pipe, 51: heat transmission pipe, 52: fin, 53: heat exchange part, 53*a*: heat exchange part, 53*b*: heat exchange part, 100: air-conditioning apparatus, 110: first flow switching unit, 111-1: first connection switching device, 111-2: first connection switching device, 112-1: second connection switching device, 112-2: second connection switching device, 120: second flow switching unit, 120*a*: second flow switching unit, 130: third flow switching unit, 130*a*: third flow switching unit, 200: air-conditioning apparatus

The invention claimed is:

1. An air-conditioning apparatus comprising:

a main circuit which is configured such that a compressor, a cooling/heating switching valve that is connected between a discharge pipe of the compressor and a suction pipe of the compressor and that performs switching of a flow direction of a refrigerant, indoor heat exchangers, first flow rate control valves, and an outdoor heat exchanger that is divided into plural parallel heat exchangers are connected by piping;

a first bypass pipe which has one end connected to the discharge pipe, and an other end divided into branch pipes which are respectively connected to first connection pipes that extend from the plural parallel heat exchangers toward the first flow rate control valves, and which supplies part of the refrigerant that has been discharged from the compressor and has then been decompressed at an expansion device to a parallel heat exchanger of the parallel heat exchangers subjected to defrosting;

a second bypass pipe which has one end connected to an injection port of the compressor that includes a compression chamber so as to communicates with the compression chamber in a process of compression, and an other end divided into branch pipes which are respectively connected to second connection pipes that extend from the respective plural parallel heat exchangers toward the compressor, and in which the refrigerant that has passed through the plural parallel heat exchangers is injected via the injection port;

a first flow switching unit which performs switching of a connection mode of ends of the plural parallel heat exchangers on a side of the compressor to one of three modes: a mode in which the ends are connected to a discharge side of the compressor; a mode in which the ends are connected to a suction side of the compressor; and a mode in which the ends are connected to neither the discharge side nor the suction side of the compressor but are connected to the injection port of the compressor;

a second flow switching unit which performs switching of a connection mode of ends of the plural parallel heat exchangers on sides opposite to the compressor to one of a mode in which the ends are connected to the first bypass pipe and a mode in which the ends are connected to a main pipe in the main circuit; and a third flow switching unit which opens and closes a flow passage inside the second bypass pipe and connects one of the plural parallel heat exchangers to the injection port when the flow passage is opened, wherein the first flow switching unit includes first connection switching devices that are provided at the second connection pipes and perform switching of a connection destination of the second connection pipes to one of a high-pressure pipe which branches off from the discharge pipe and a low-pressure pipe which branches off from the suction pipe, wherein a pressure of the refrigerant flowing through the high-pressure pipe is greater than a pressure of the refrigerant flowing through the low-pressure pipe, and second connection switching devices that are provided at respective pipes connecting the second connection pipes with the high-pressure pipe and that perform switching of a connection mode of the second connection pipes to one of a mode in which the second connection pipes are connected to the high-pressure pipe and a mode in which the second connection pipes are disconnected from the high-pressure pipe, when the connection destination of the second connection pipes is switched toward the high-pressure pipe by the first connection switching devices, wherein the first connection switching devices include high/low pressure switching devices each including a three-way valve or a four-way valve having three ports or four ports respectively, the first connection switching devices are configured such that check valves are connected in series to third ports of the high/low pressure switching devices, a first port of which is connected to the high-pressure pipe and a second port of which is connected to the low-pressure pipe so that the refrigerant is allowed to flow only from sides of the second connection pipes to the high/low pressure switching devices, and wherein the second connection switching devices are switching devices which each include a unidirectional solenoid valve, or switching devices that are configured such that check valves are connected in series to third ports of three-way valves or four-way valves that first ports of which are connected to the high-pressure pipe and second ports of which are connected to the low-pressure pipe so that the refrigerant is allowed to flow only from the three-way valves or the four-way valves to the second connection pipes.

2. The air-conditioning apparatus of claim 1, wherein the third flow switching unit is a switching device which includes a unidirectional solenoid valve and a check valve that are provided at each of the branch pipes extending from the second bypass pipe, or a switching device which is configured such that a check valve is connected in series to a third port of a three-way valve or a four-way valve a first port of which is connected to the high-pressure pipe and a second port of which is connected to a part of the second bypass pipe that is not divided into branch pipes so that the refrigerant is allowed to flow only from the sides of the second connection pipes to the second bypass pipe.

3. The air-conditioning apparatus of claim 1, wherein the second flow switching unit is a switching device which includes second flow rate control valves that are provided at the respective first connection pipes and unidirectional solenoid valves that are provided at the respective branch pipes extending from the first bypass pipe, or a switching device which includes second flow rate control valves that are provided at the first connection pipes, and three-way valves or four-way valves that are provided at the first connection pipes, first ports of the three-way valves or the four-way valves being connected to the first bypass pipe, second ports of the three-way valves or the four-way valves being connected to the main pipe extending from the first flow rate control valves toward the parallel heat exchangers in the main circuit, and which perform switching of a connection destination of the first connection pipes to one of the first bypass pipe and the main pipe.

4. The air-conditioning apparatus of claim 1, wherein the outdoor heat exchanger is divided into vertically aligned portions to form the parallel heat exchangers, and defrosting of the parallel heat exchangers is performed in an order of an upper one of the parallel heat exchangers and then a lower one of the parallel heat exchangers during a heating and defrosting operation.

5. The air-conditioning apparatus of claim 1, wherein in each of the parallel heat exchangers, plural heat exchange parts each including plural heat transmission pipes, through which a refrigerant passes and which are arranged in a step direction which is vertical relative to an air passing direction, and plural fins arranged with spaces therebetween so that air passes in the air passing direction, are arranged in a column direction which is the air passing direction, the first connection pipes are connected to the heat exchange parts on an upwind side of the air passing direction, and the second connection pipes are connected to the heat exchange parts on a downwind side of the air passing direction.

6. The air-conditioning apparatus of claim 5, wherein in the outdoor heat exchanger, the spaces between the plural fins in the heat exchange parts on an upstream side of the air passing direction are wider than the spaces between the plural fins in the heat exchange parts on a downstream side of the air passing direction.

7. The air-conditioning apparatus of claim 1, wherein a fan which blows air is installed at each of the plural parallel heat exchangers.

8. The air-conditioning apparatus of claim 1, further comprising:

a third flow rate control device that decompresses the refrigerant which is split off from the refrigerant that has flowed out of the first flow rate control valves in the main circuit; and an inner heat exchanger which exchanges heat between the refrigerant obtained by merging the refrigerant that has been decompressed at the third flow rate control device and the refrigerant that has passed through the third flow switching unit together, and the refrigerant that has flowed out of the first flow rate control valves in the main circuit.

* * * * *